US007159720B2

(12) United States Patent
Pearson

(10) Patent No.: US 7,159,720 B2
(45) Date of Patent: Jan. 9, 2007

(54) CONTAINER HAVING A ROTATABLE RING

(76) Inventor: Stephen J. Pearson, 34420 N. Converse La., Ingleside, IL (US) 60041

( * ) Notice: Subject to any disclaimer, the term of this patent is extended or adjusted under 35 U.S.C. 154(b) by 0 days.

(21) Appl. No.: 10/803,302

(22) Filed: Mar. 18, 2004

(65) Prior Publication Data

US 2005/0205458 A1 Sep. 22, 2005

(51) Int. Cl.
*B65D 83/04* (2006.01)

(52) U.S. Cl. ..... 206/533; 206/540

(58) Field of Classification Search ..... 206/533, 206/534, 538, 539, 540, 818; 221/89, 91, 221/265, 264, 277; 220/483
See application file for complete search history.

(56) References Cited

U.S. PATENT DOCUMENTS

| | | | | | |
|---|---|---|---|---|---|
| 153,308 | A | * | 7/1874 | Blood | 206/536 |
| 662,353 | A | * | 11/1900 | Clement | 222/553 |
| 1,891,817 | A | | 12/1932 | Hildebrand | |
| 2,219,487 | A | | 10/1938 | Nyden | |
| 2,360,543 | A | | 10/1944 | Bixler | |
| 2,408,150 | A | * | 9/1946 | Moeller | 206/533 |
| 2,549,681 | A | * | 4/1951 | Goldstaub | 206/528 |
| 2,655,259 | A | | 10/1953 | Davoren | |
| 2,722,309 | A | | 11/1955 | Waterman | |
| 2,774,466 | A | * | 12/1956 | Liska | 206/538 |
| 3,042,256 | A | | 7/1962 | Sanner | |
| 3,871,522 | A | * | 3/1975 | Feldman | 206/540 |
| 3,984,031 | A | | 10/1976 | Thompson | |
| 4,069,942 | A | | 1/1978 | Marshall | |
| 4,124,143 | A | | 11/1978 | Thomas | |
| 4,126,224 | A | | 11/1978 | Laauwe | |
| 4,127,190 | A | | 11/1978 | Sunnen | |
| 4,164,301 | A | | 8/1979 | Thayer | |
| 4,203,518 | A | * | 5/1980 | Current | 206/380 |
| 4,204,611 | A | | 5/1980 | Graves | |
| 4,230,237 | A | | 10/1980 | de Wit | |
| 4,261,468 | A | | 4/1981 | Krebs | |
| 4,262,802 | A | | 4/1981 | Laauwe | |
| D259,858 | S | | 7/1981 | Finkel | |
| 4,288,006 | A | | 9/1981 | Clover, Jr. | |
| 4,334,617 | A | | 6/1982 | Rossmo | |
| 4,378,885 | A | * | 4/1983 | Leopoldi et al. | 206/540 |
| 4,399,914 | A | | 8/1983 | Damratowski | |
| 4,418,838 | A | | 12/1983 | Gallina | |

(Continued)

FOREIGN PATENT DOCUMENTS

JP 05139448 A * 6/1993

*Primary Examiner*—Mickey Yu
*Assistant Examiner*—Jerrold Johnson
(74) *Attorney, Agent, or Firm*—Gavrilovich, Dodd & Lindsey, LLP

(57) ABSTRACT

A generally cylindrical container comprised of three parts including a top shell, a bottom shell, and a rotatable ring. The top and bottom shells are affixed to each other and hold the ring captive in a race formed by the outer sidewalls and annular retaining edges of the top and bottom shell. A discharge opening in the ring can be aligned with one or more openings in the sidewalls to allow passage of objects in or out of the container. The ring opening can similarly be aligned away from the sidewall opening(s) to prevent the passage of objects. The container disclosed herein represents a significant advance over known hand-operated containers because, among other things, it is simpler to manufacture, provides more reliable operation, and offers reduced friction against stored objects.

23 Claims, 6 Drawing Sheets

U.S. PATENT DOCUMENTS 4,432,300 A 2/1984 Lyss
4,512,500 A 4/1985 Belbin, Sr.
4,524,869 A 6/1985 Nader
4,555,044 A 11/1985 Pearo
4,569,462 A * 2/1986 Belokin ..... 222/180
4,572,376 A 2/1986 Wrennall
4,583,661 A 4/1986 Clover, Jr.
4,583,667 A 4/1986 Fishman
4,611,727 A 9/1986 Graff
4,749,085 A 6/1988 Denney
4,753,340 A 6/1988 Blakeman
4,756,434 A 7/1988 Frank
4,778,054 A 10/1988 Newell
4,782,981 A 11/1988 Schuster
4,785,932 A 11/1988 Checke
4,826,043 A 5/1989 Matz
4,838,426 A * 6/1989 Dalbo ..... 206/574
5,020,037 A 5/1991 Raven
5,123,539 A 6/1992 de Vries
5,226,539 A 7/1993 Cheng
5,255,786 A 10/1993 McQuay
5,261,564 A 11/1993 Yelvington
5,322,166 A 6/1994 Crowther
5,325,968 A 7/1994 Sowden
5,348,158 A 9/1994 Honan
5,361,908 A 11/1994 Drew
5,372,258 A 12/1994 Daneshvar
5,373,940 A 12/1994 Hillelson
5,383,559 A 1/1995 Toren
5,443,178 A 8/1995 Holmes
5,501,337 A 3/1996 Sowden
5,575,392 A 11/1996 Cutler
5,697,127 A 12/1997 Tyler
5,762,199 A 6/1998 Aguilera
5,782,359 A 7/1998 McAllister
5,788,974 A 8/1998 D'Amico
D398,444 S 9/1998 Ricci
5,806,670 A 9/1998 Harlan
D402,552 S 12/1998 Reymond
5,915,558 A 6/1999 Girvetz
5,921,394 A 7/1999 Shroff
5,921,395 A * 7/1999 Alexander ..... 206/538
6,126,010 A 10/2000 Kogen
D433,935 S 11/2000 Lewis
6,176,391 B1 1/2001 Rehkemper
D439,155 S 3/2001 Lewis
6,247,595 B1 6/2001 Omata
6,325,241 B1 * 12/2001 Garde et al. ..... 221/87
6,341,710 B1 1/2002 Danielson
6,375,225 B1 4/2002 Lapsker
6,382,410 B1 5/2002 Magid
D464,895 S 10/2002 Ng
6,471,064 B1 10/2002 Gordon
D469,700 S 2/2003 Ng
6,662,081 B1 12/2003 Jacober
6,758,338 B1 * 7/2004 Lien ..... 206/534

* cited by examiner

CONTAINER HAVING A ROTATABLE RING

TECHNICAL FIELD

The invention relates generally to containers, and in particular to hand-operated dispensing containers.

BACKGROUND

Hand-operated dispensing containers have been and continue to be available in a wide variety of designs. Dispensing containers are used for holding and dispensing just about any type of small object, from medications, pills, tablets, breath mints, screws, washers, nuts, etc. to fishing hooks and weights. Related patents describe such containers as being adapted for carrying on one's person, and ranging from simple to elaborate in function. Some container designs have single storage compartments, while others include multiple, separate compartments to correspond with periodic use of the contents. Some multi-compartment containers have a side-by-side arrangement with lids that snap open or closed. One problem with such containers is that their lids can open unexpectedly, spilling the contents. Other multi-compartment containers are round and have compartments that are accessed by rotating a top half in relation to a bottom half. These containers are typically accessed through their rotatable tops, such as the container disclosed in U.S. Pat. No. 4,261,468 to Krebs. Although useful for storing some types of objects, these top-loading containers can subject their contents to excessive abrasion caused by the rotation of their tops. This lessens their desirability for storing certain objects.

U.S. Pat. No. 4,378,885 to Leopoldi et al., teaches a single compartment circular container with a slip ring means of closure that also has a discharge port that is perpendicular to the slip ring axis of rotation. The '885 container has enjoyed a degree of commercial success. However, a deficiency with the '885 container is that the slip ring also serves as the means to fasten top and bottom halves of the container together, introducing inconsistent levels of friction between the slip ring and the container; operating difficulties, and manufacturing difficulties.

Thus, there is a need for an improved hand-operated dispensing container that overcomes at least the aforementioned limitations of known containers.

SUMMARY

It is an advantage of the present invention to provide a unique dispensing container that offers significantly improved manufacturability, functionality, and ease of use. The inventive container utilizes a rotatable circumferential ring for dispensing container contents. The rotatable ring approach reduces inadvertent spillage of contents and allows a level of child-proof closure. This approach also has advantage in that it provides a reduced-abrasion, rotary closure for the container that does not require leaving one compartment empty in multi-compartment embodiments. The container can be sold pre-loaded with items, and thus, the scope of the invention extends to the container itself, as well as to the combination of the container and its contents.

In accordance with an exemplary embodiment of the invention, an essentially round, hand-operated dispensing container is formed from a top shell mated with a bottom shell and a rotatable ring. Each shell comprises an essentially flat bottom or top, respectively, and a cylindrical outer sidewall. When the shells are mated together, an enclosure is formed for storing objects, and the outer sidewalls form a bearing race for the external ring to rotate about. The top and bottom each have means to provide lateral containment of the ring in the race. An opening is provided in at least one of the sidewalls. An opening in the ring can be selectively aligned with the sidewall opening to allow passage of objects into or out of the container. To close the container, the ring opening is rotated away from the sidewall opening.

In accordance with another exemplary embodiment of the invention, a round hand-operated dispensing container includes top and bottom shells, which each include interior partitioning walls that mate to form multiple separate compartments. Each compartment has its own sidewall opening, making it separately accessible by rotation of the ring.

In accordance with a further exemplary embodiment of the invention, a round hand-operated dispensing container includes a lid that allows access to multiple compartments simultaneously. The lid can be formed in either the top or bottom shell. In this embodiment, the container can include one or more central compartments that are accessible only through the lid opening and not through the ring opening(s). The lid permits the container compartments to be easily loaded with objects. This is particularly useful for preloading the container with items, such as pills or tablets, prior to distributing it to end users.

In accordance with an aspect of the invention, a dispensing container includes one or more magnets or magnetic material that allow the container to be stuck to metal surfaces or objects.

Other embodiments, aspects, methods, features and advantages of the invention will be or will become apparent to one with skill in the art upon examination of the following figures and detailed description. It is intended that all such additional embodiments, systems, methods, features and advantages be included within the scope of the invention, and be protected by the accompanying claims.

BRIEF DESCRIPTION OF THE DRAWINGS

The components in the figures are not necessarily to scale, emphasis instead being placed upon illustrating the principles of the invention. Like element numbers in different figures indicate the same element.

DETAILED DESCRIPTION

Figure 1A:
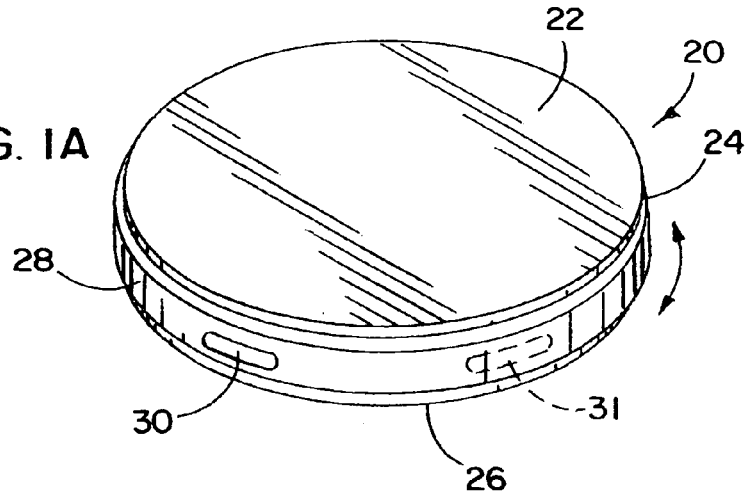
FIG. 1A is a perspective view of a hand-operated container in accordance a first exemplary embodiment of the invention.
Figure 1B:
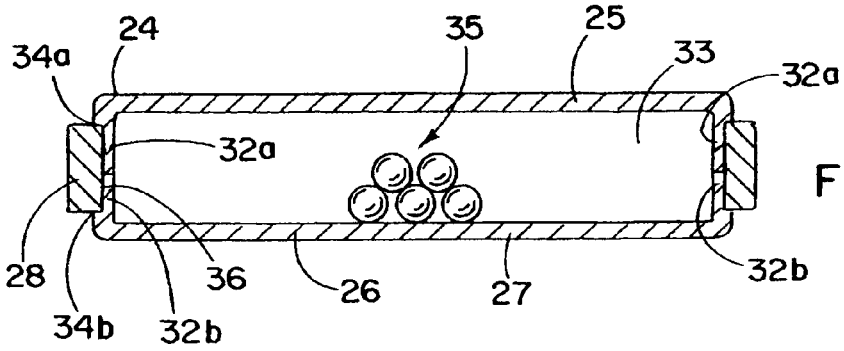
FIG. 1B is a cross-sectional view of the container shown in FIG. 1A.
Figure 1C:
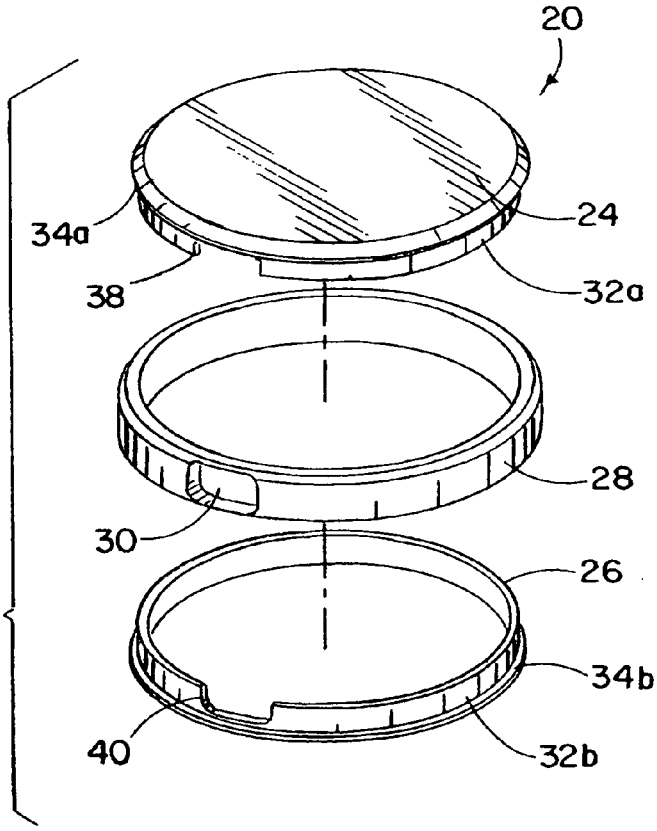
FIG. 1C is an exploded view of the container shown in FIG. 1A.

Turning now to the drawings, and in particular to FIGS. 1A–C, there is illustrated various views of a hand-operated single compartment container 20 in accordance a first embodiment of the invention. While the container 20 may be used for a variety of applications, the example of a pill box provides useful illustration.

The container 20 has a generally cylindrical shape and comprises a body 22 and a rotatable exterior ring 28 surrounding the body 22. The ring 28 includes a discharge opening 30. The contents 35 of the container 20 can be removed or inserted through the discharge opening 30 when the ring 28 is rotated to align the ring discharge opening 30 with a sidewall discharge opening 31 of the body 22. To close the container 20, the ring 28 is rotated so that the ring discharge opening 30 is away from the sidewall opening 31, as shown.

The body 22 comprises a top shell 24 and a mated bottom shell 26. The top shell 24 includes a substantially circular flat top 25 and a substantially cylindrical upper outer sidewall 32*a* extending down from the top 25. The top 25 overhangs the upper outer sidewall 32*a* to form an upper annular retaining edge 34*a* extending away from the upper outer sidewall 32*a*. The bottom shell 26 includes a substantially circular flat bottom 27 and a substantially cylindrical lower outer sidewall 32*b* extending up from the bottom 27. The bottom 27 underhangs (extends out and away from) the lower outer sidewall 32*b* to form a lower annular retaining edge 34*b* extending away from the lower outer sidewall 32*b*.

When the top shell 24 and the bottom shell 26 are mated together in an assembled relation (FIG. 1A), they form an enclosure 33 for storing the contents 35 (FIG. 1B). The mated shells 24,26 also form the sidewall discharge opening 31 from two corresponding half discharge openings 38,40 formed in the upper and lower sidewalls 32*a*–*b* (FIG. 1C).

A race 36 for the ring 28 is also formed when the top and bottom shells 24,26 are assembled. The race 36 is defined by the upper annular retaining edge 34*a*, the lower annular retaining edge 34*b*, and the exterior surfaces of the upper and lower outer sidewalls 32*a*–*b*. The annular retaining edges 34*a*–*b* limit the lateral movement of the ring 28 as it is rotated in the race 36.

The contents 35 of the container 20 can include any item that is capable of passing through the discharge openings 30,31, such as medications, pills, tablets, candy, mints, small parts such as screws, washers, nuts, bolts, electrical components, fishing lures, hooks, weights, or the like. The discharge openings 30,31 can be any suitable size or shape capable of being formed on the sidewalls and ring 32,28.

A significant advantage of the inventive container is its ease and consistency of manufacture. This greatly improves its overall quality, while reducing cost. To assemble the container 20, the rotatable ring 28 is placed around lower out sidewall 32*b*. The top shell 24 is aligned to the bottom shell 26, and the upper sidewall 32*a* is then inserted into the ring 28. The top and bottom shells 24,26 are then fastened together in the assembled relation so that the ring 28 can be rotated in the race 36. Generally, the other container embodiments disclosed herein are assembled in this manner.

The top and bottom shells 24,26 can be fastened together using any suitable means, such as an adhesive, friction fitting members, fasteners such as screws, or the like.

The top and bottom shells 24,26 can be made of any suitable material, and are preferably made of an injection molded thermoplastic such as ABS or K-Resin. The container shells disclosed herein are preferably clear, so that a user can see the contents. The ring 28 can likewise be made of any suitable material, and is preferably injection molded polyolefin. Generally, the other container embodiments disclosed herein can be made with these preferred materials.

Tamper evidencing means (not shown) can be included with the container 20 (as well as the other container embodiments disclosed herein). The tamper evidencing means can include a sticker or label applied over portions of both the ring 28 and body 22 during assembly. The sticker or label is torn upon first use of the container 20, when the ring 28 is first rotated. Alternatively/additionally, the container 20 can be packaged in a shrink wrap plastic, which will also evidence of tampering.

Figure 2A:
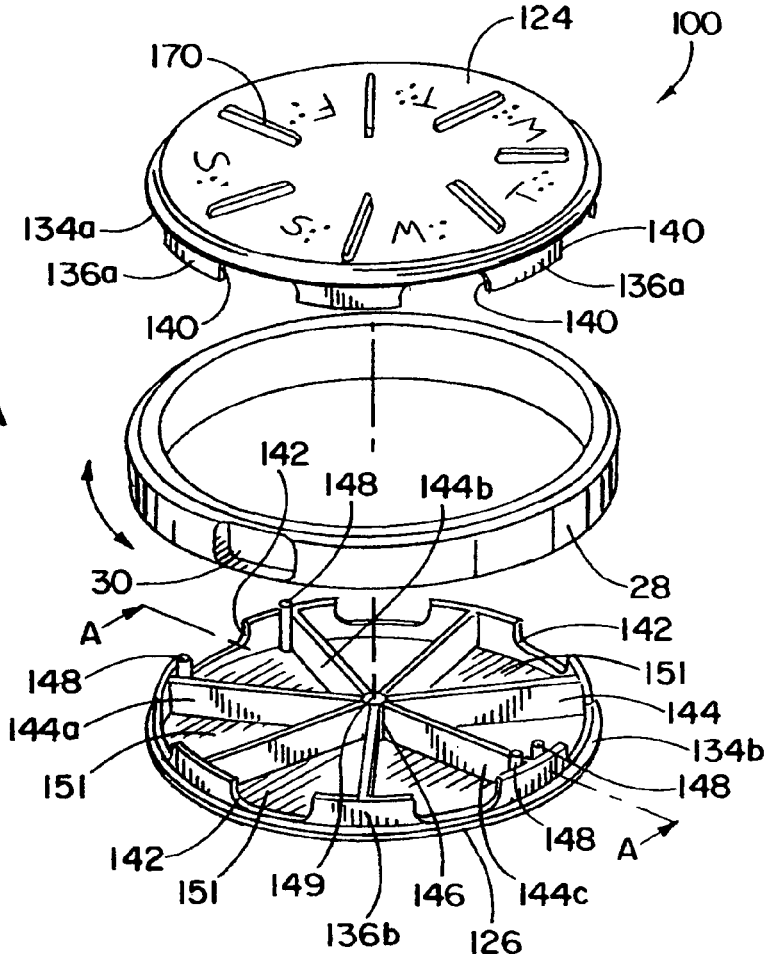
FIG. 2A is an exploded view a hand-operated container in accordance with a second exemplary embodiment of the invention.
Figure 2B:
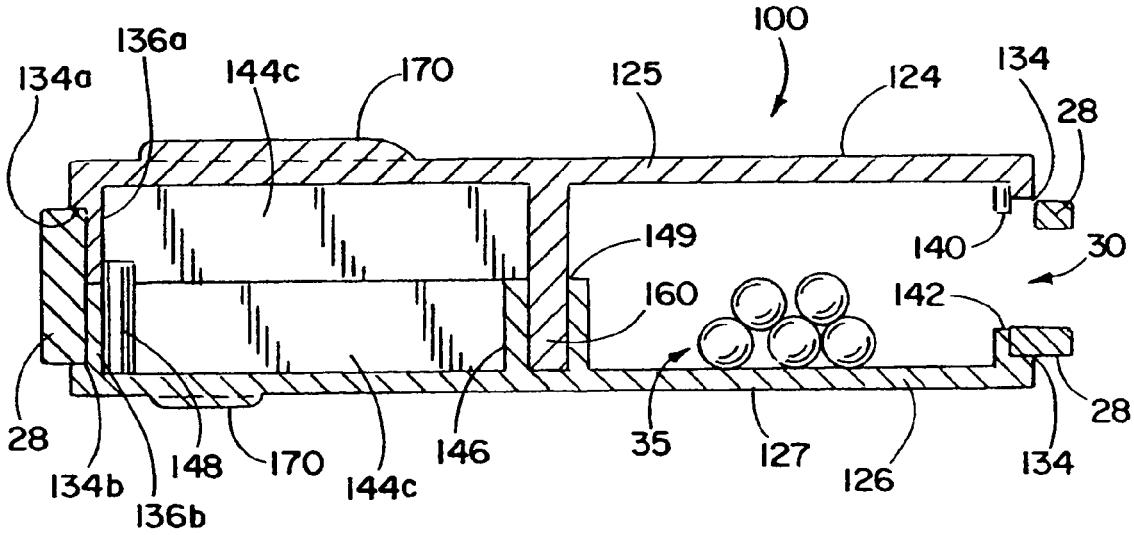
FIG. 2B is a cross-sectional view along axis A of the container shown in FIG. 2A.

FIGS. 2A–B are exploded and cross-sectional views, respectively, of a hand-operated container 100 in accordance with a second exemplary embodiment of the invention. The container 100 includes multiple separate compartments 151. To provide multiple compartments 151, the container 100 includes top and bottom shells 124,126, which each include interior partitioning walls 144 that mate to form the multiple separate compartments 151 in the assemble relation. Each compartment 151 has its own sidewall opening formed by corresponding half discharge openings 140,142, making it separately accessible by rotation of the ring 28.

The container 100 comprises a top shell 124 and a mated bottom shell 126. The top shell 124 includes a substantially circular flat top 125 and a substantially cylindrical upper outer sidewall 136*a* extending down from the top 125. The top 125 overhangs the upper outer sidewall 136*a* to form an upper annular retaining edge 134*a* extending away from the upper outer sidewall 136*a*. The top shell 124 also includes a plurality of integrally formed interior walls 144 extending radially from the center of the top 125 to the upper outer sidewall 136*a*. The upper outer sidewall 136*a* has a plurality of half discharge openings 140 formed therein.

The mated bottom shell 126 includes a substantially circular flat bottom 127 and a substantially cylindrical lower outer sidewall 136*b* extending up from the bottom 127. The bottom 127 underhangs (extends out and away from) the lower outer sidewall 136*b* to form a lower annular retaining edge 134*b* extending away from the lower outer sidewall 136*b*. The bottom shell 126 also includes a plurality of integrally formed interior walls 144 extending radially from the center of the bottom 127 to the lower outer sidewall 136*b*. The lower outer sidewall 136*b* has a plurality of half discharge openings 142 formed therein.

When the top shell 124 and the bottom shell 126 are mated together in an assembled relation, they form the compartments 151 each having their own sidewall opening.

A race for the ring 28 is also formed when the top and bottom shells 124,126 are assembled. The race is defined by the upper annular retaining edge 134*a*, the lower annular retaining edge 134*b*, and the exterior surfaces of the upper and lower outer sidewalls 136*a*–*b*. The annular retaining edges 134*a*–*b* limit the lateral movement of the ring 28 as it is rotated in the race.

The container 100 includes one or more alignment members 148 formed on either the top shell 124 or bottom shell 126. The alignment members can be any suitable means for properly aligning the shells 124,126 into the assembled relation having multiple compartments 151 and sidewall discharge openings. In the example shown, the alignment members 148 are integrally formed pins extending up from the bottom shell 126. Two pins are placed against the interior surface of the outer sidewall 136*b* on either side of interior wall 144*c* for engaging the upper outer sidewall 136*a* and either side of the corresponding interior wall of the top shell 124. Two other pins are placed against the interior surface of the outer sidewall 136*b* and against two interior walls 144*a,b* for engaging the upper outer sidewall 136*a* and corresponding interior walls of the top shell 124.

The top and bottom shells 124,126 are frictionally fastened together using a mated center pin 160 and column 146. The center column 146 is integrally formed in the bottom shell 126 and upwardly extends from the bottom 127. A bore 149 for receiving the pin 160 is formed in the center column 146. The center pin 160 is integrally formed in the top shell 124 and downwardly extends from the top 125. The center pin 160 frictionally engages the bore 149 to securely fasten the top and bottom shells 124,126 together in the assembled relation.

Other structures can be used to frictionally fasten together the top and bottom shells 124,126, and the invention is not limited to the example structure shown in FIGS. 2A–B. For example, the pin 160 and column 146 can be reversed, with the pin 160 extending from the bottom 127 and the column extending from the top 125, instead of the other way around. Also, the fastening means does not have to be centrally located in the shells 124,126 and more than one friction contact can be used.

The container 100 includes other useful features, such as finger lugs 170 integrally formed on the exterior of the top 125 and bottom 127. The finger lugs 170 allow a user to get a better grip on the body of the container 100 when turning the ring 28. Although shown as being on both the top 125 and bottom 127 of the container 100, the lugs 170 can alternatively be formed on only one side. The container 100 also includes indicia on the top 125 corresponding to each compartment 151. In the example, the indicia include letters and Braille corresponding to the first letters of the days of the week. The indicia can be raised and integrally formed on the top 125 or bottom 127.

Figure 3:
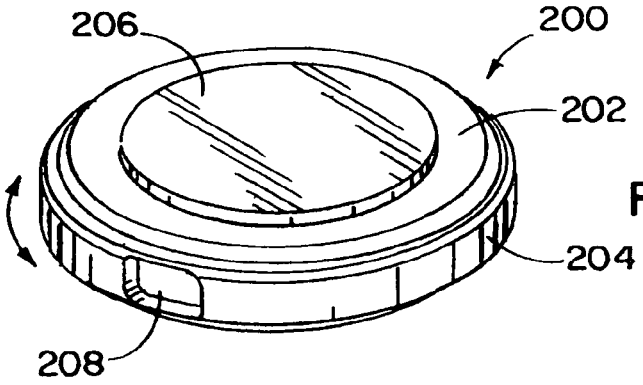
FIG. 3 is a perspective view of a hand-operated container including a magnetic sheet.

FIG. 3 is a perspective view of a hand-operated container 200 including a magnetic sheet 206. The container 200 includes a body 202 and a rotatable ring 204 having a discharge opening 208. The sheet of magnetic material 206 is glued to the body 202 of the container 200. The magnetic material 206 allows the container 200 to be stuck to metal surfaces or objects. This allows users to conveniently locate the container 200 on objects such as cabinets, refrigerators or medicine cabinets. The magnetic material 206 can be incorporated into the other container embodiments disclosed herein.

Figure 4:
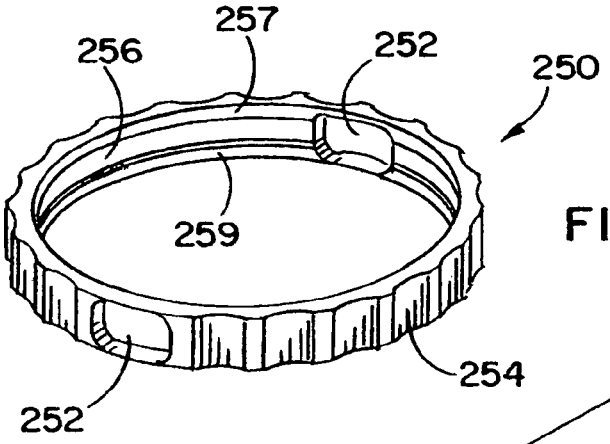
FIG. 4 is a perspective view of a rotatable ring that can be used with the hand-operated containers disclosed herein.

FIG. 4 is a perspective view of an alternative rotatable ring 250 that can be used with the hand-operated containers disclosed herein. The ring 250 includes means to increase friction or comfort between the user's fingers and the ring's outer surface, such as finger grips 254. The ring 250 also includes means to decrease friction between the ring's bearing surface and the container race. In the example shown, a center groove 256 in formed on the interior surface of the ring 250, leaving two reduced surfaces 257,259 for bearing against the container race. The ring 250 further includes multiple discharge openings 252 for accessing multiple compartments simultaneously.

The various features of the ring 250 (i.e., finger grips, interior groove, and multiple discharge openings) can be employed individually or in combination with one another.

Figure 5:
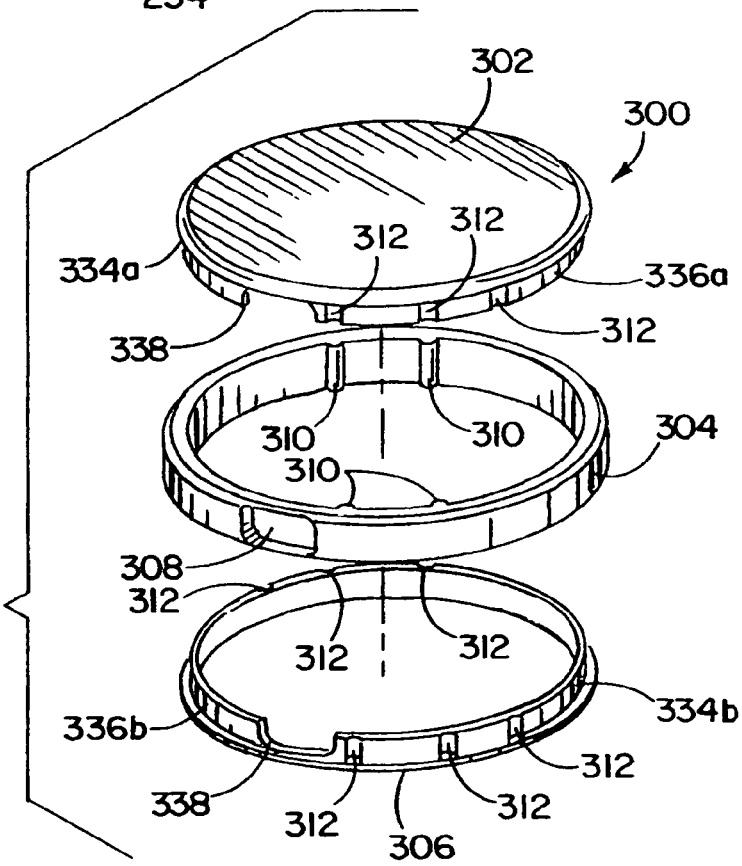
FIG. 5 is an exploded view a hand-operated container including a detent mechanism in accordance with a third exemplary embodiment of the invention.

FIG. 5 is an exploded view a hand-operated container 300 including a detent mechanism in accordance with a third exemplary embodiment of the invention. The detent mechanism allows detent action of the ring 304, thereby providing passively maintainable alignment or juxtaposition of the ring discharge opening 308 and sidewall opening(s) 338.

The container 300 comprises a top shell 302 and a mated bottom shell 306. The top shell 302 includes a cylindrical upper outer sidewall 336*a* extending down from the top. The top overhangs the upper outer sidewall 336*a* to form an upper annular retaining edge 334*a* extending away from the upper outer sidewall 336*a*. The bottom shell 306 includes a substantially circular flat bottom and a substantially cylindrical lower outer sidewall 336*b* extending up from the bottom. The bottom underhangs (extends out and away from) the lower outer sidewall 336*b* to form a lower annular retaining edge 334*b* extending away from the lower outer sidewall 336*b*.

The detent mechanism includes notches 312 formed on the exterior surface of the outer sidewalls 336*a–b* and mated projections 310 formed on the interior surface of the ring 304. The notches 312 and projections 310 are located so that as the ring 304 is rotated, it can click-stop in to desired positions, such as a container open position with the ring and sidewall discharge openings 308, 338 aligned, or a container closed position with the ring opening 308 stopped away from the sidewall opening 338.

Figure 6:
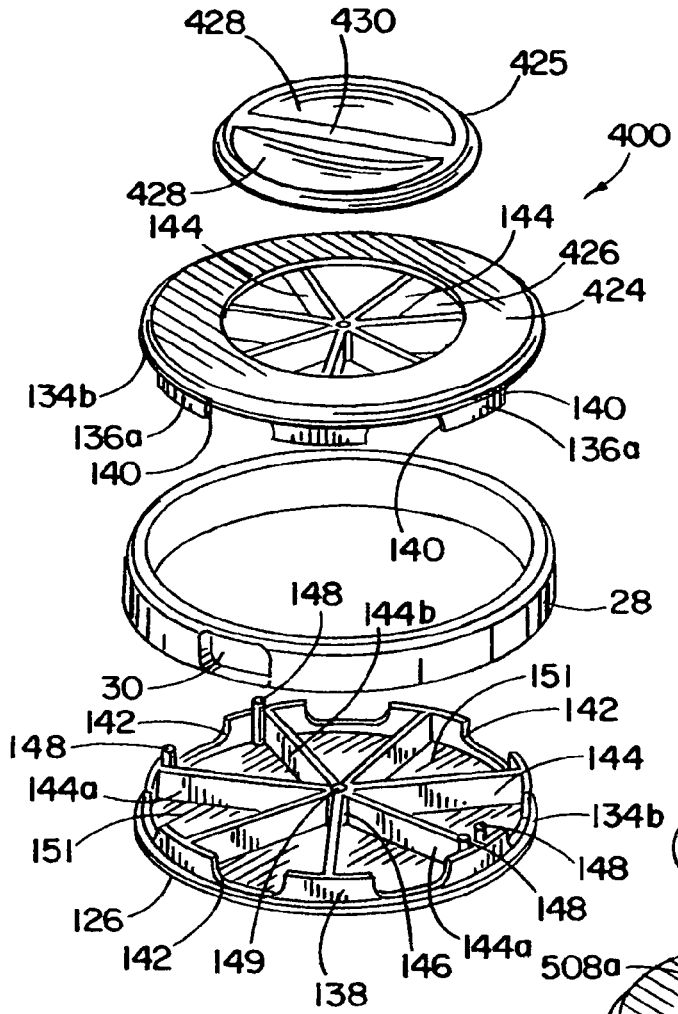
FIG. 6 is an exploded view a hand-operated container including a lid in accordance with a four exemplary embodiment of the invention.

FIG. 6 is an exploded view a hand-operated container 400 including a lid 425 in accordance with a four exemplary embodiment of the invention. The lid 425 allows a user to conveniently load, unload, and reload a compartment or compartments. The lid 425 can be used with either single or multiple compartment containers.

The top shell 424 includes a lid opening 426 formed therein. The lid 425 can be a twist-and-lock lid mated to the opening 426. The lid 425 includes indentations 428 formed on either side of finger grip 430, allowing a user to twist the lid 425.

Figure 7:
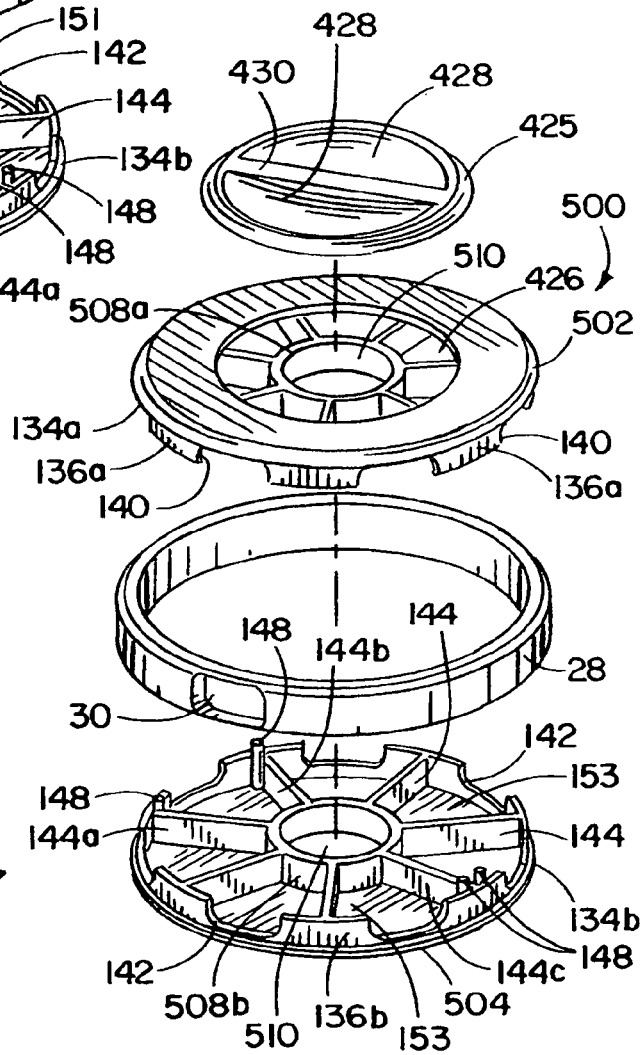
FIG. 7 is an exploded view a hand-operated container including a lid and a center compartment in accordance with a fifth exemplary embodiment of the invention.

FIG. 7 is an exploded view a hand-operated container 500 including a lid 425 and a center compartment 510 in accordance with a fifth exemplary embodiment of the invention. The center compartment 510 is accessible only by removing the lid 425 and is formed by cylindrical interior walls 508*a,b*, which are integrally formed in the top and bottom shells 502,504, respectively. The center compartment 510 is useful for storing excess contents when the outer compartments 153 are used for storing prescribed amounts of items, such a dosages of daily medications.

Figure 8:
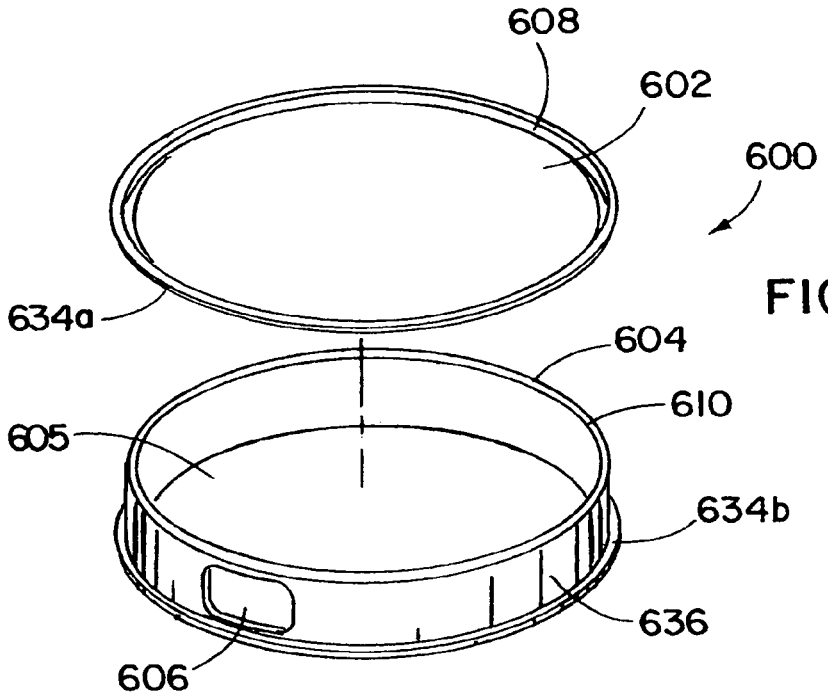
FIGS. 8–9 are exploded views of container bodies including receiving grooves.
Figure 9:
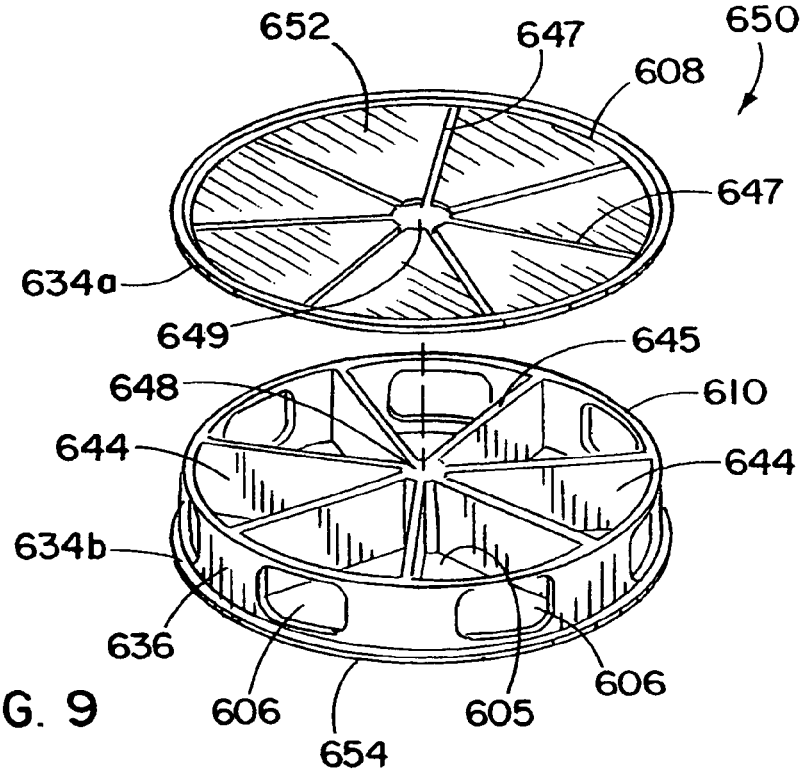

FIGS. 8–9 are exploded views of container bodies 600, 650 including receiving grooves 608,647,649. Both bodies 600,650 are used with rotatable rings (not shown) capable of being hand-turned in a race, as discussed above.

FIG. 8 shows a single compartment container body 600 having a top shell 602 and a bottom shell 604. The bottom shell 604 includes a flat circular bottom 605 and an outer sidewall 636 extending therefrom. A discharge opening 606 is formed in the sidewall 636. The top shell 602 has an annular groove 608 formed therein for receiving the top edge portion 610 of the sidewall 636 in the assembled relation. Annular retaining edges 634*a,b* extend beyond the sidewall 636 to form the ring race, as discussed above. The shells 602,604 can be fastened together by the top edge portion 610 frictionally engaging the annular groove 608 and/or using an adhesive to glue the edge portion 610 into the groove 608.

FIG. 9 shows a multi-compartment container body 650 having a top shell 652 and a bottom shell 654. The bottom shell 604 has a bottom 605 and plural interior walls 644 and a center post 648 extending therefrom. Plural discharge openings 606 are formed in the sidewall 636. The top shell 652 has the annular groove 608 formed therein for receiving the top edge portion 610 of the sidewall 636 in the assembled relation. In addition, the shell 652 has grooves 647,649 for receiving the interior wall edge portions 645 and top portion of the center post. The shells 652,654 can be fastened together by the top edge portions 610, 645 frictionally engaging the grooves 608, 647, 649 and/or by using an adhesive.

Figure 10:
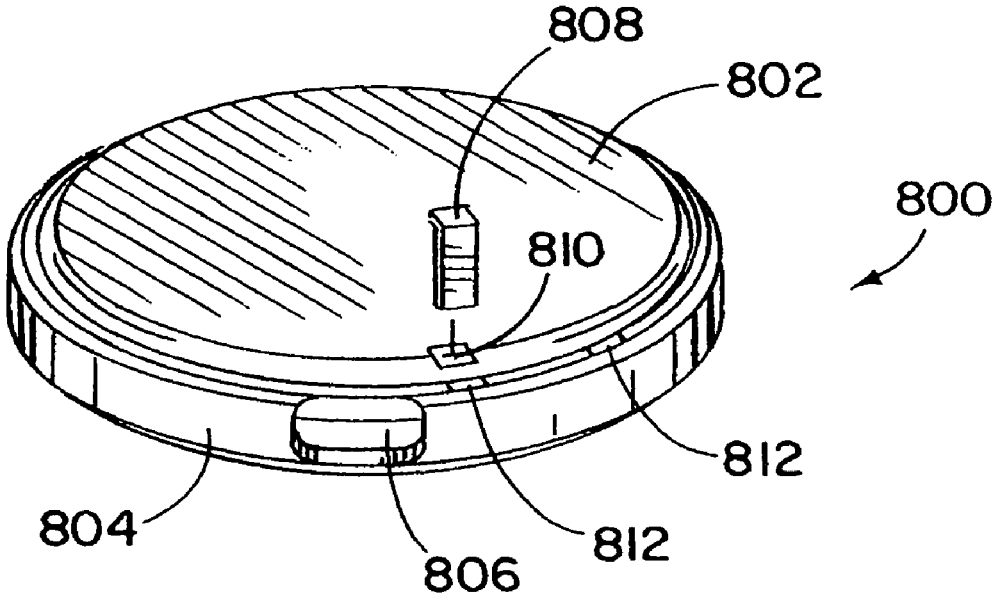
FIGS. 10–11 are perspective views of hand-operated containers including locking mechanisms.
Figure 11:
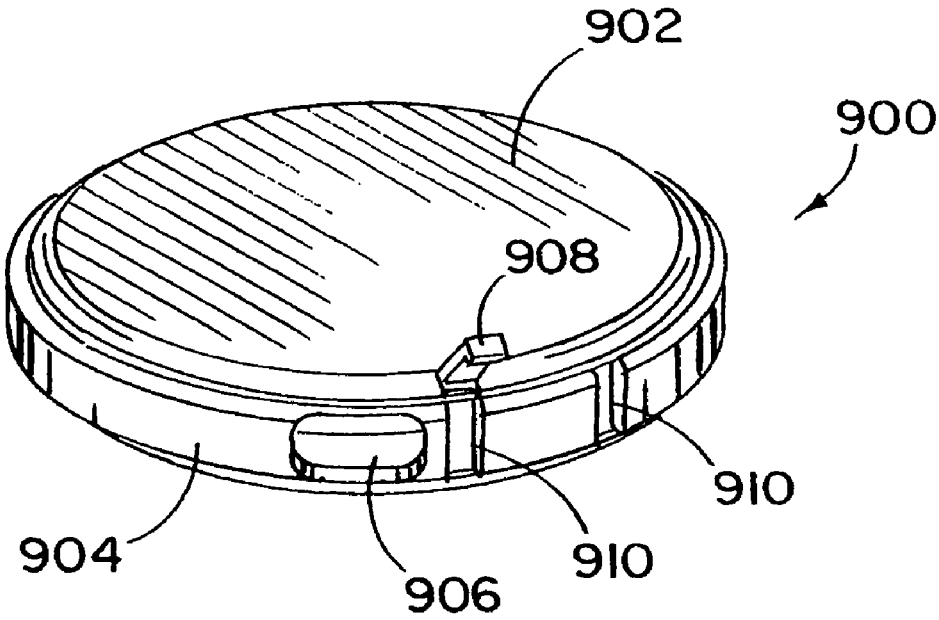

FIGS. 10–11 are perspective views of hand-operated containers 800,900 including locking mechanisms. The locking mechanisms can be incorporated into any of the container embodiments disclosed herein.

As shown in FIG. 10, the container 800 includes a key 808 and keyhole 810 arrangement. The removable key 808 can be inserted into a keyhole 810 formed in the body 802 of the container 800. The ring 804 includes one or more interior notches 812 for receiving the key 808 when it is inserted into the keyhole 810. By rotating the ring 804 to align one of the notches 812 with the keyhole 810, the key 808 can be inserted to lock the ring 804 in place. Using this mechanism, the ring opening 806 can be locked into a desired position.

FIG. 11 shows a container 900 having a latch locking mechanism. The latch mechanism includes a latch 908 that is hinged to the container body 902. The ring 904 includes one or more exterior notches 910 for receiving the latch 908. By rotating the ring 904 to align one of the notches 910 with the latch 908, the latch 908 can be closed to lock the ring 904 in place. Using this mechanism, the ring opening 906 can be locked into a desired position.

While various embodiments of the invention have been described, it will be apparent to those of ordinary skill in the art that many more embodiments and implementations are possible that are within the scope of this invention. For example, any combination of any of the systems or methods described in this disclosure are possible.

What is claimed is:

1. A hand-operated container having a generally cylindrical shape, comprising:

a top shell including a substantially circular top and a substantially cylindrical upper outer sidewall extending down from the top, the top overhanging the upper outer sidewall to form an upper annular retaining edge extending away from the upper outer sidewall;

a bottom shell including a substantially circular bottom and a substantially cylindrical lower outer sidewall extending up from the bottom, the bottom underhanging the lower outer sidewall to form a lower annular retaining edge extending away from the lower outer sidewall;

wherein the top shell and the bottom shell are mated to form an enclosure, a sidewall discharge opening, and a race when the top and bottom shells are place in an assembled relation, the enclosure being defined by the top, the bottom and the upper and lower outer sidewalls and the race being defined by the upper annular retaining edge, the lower annular retaining edge, and the exterior surfaces of the upper and lower outer sidewalls; and a ring having a ring discharge opening and being fitted to the race for rotating in the race, the ring permitting access to the enclosure when the ring is rotated to align the ring discharge opening with the sidewall discharge opening.

2. The hand-operated container of claim 1, further comprising:

a plurality of interior walls extending between the top and bottom for forming a plurality of compartments within the enclosure.

3. The hand-operated container of claim 2, wherein the interior walls extend radially from the center of the container.

4. The hand-operated container of claim 2, further comprising a plurality of sidewall discharge openings, each of the sidewall discharge openings corresponding to one of the compartments.

5. The hand-operated container of claim 1, further comprising:

a center column upwardly extending from the bottom;

a bore formed in the center column; and a center pin downwardly extending from the top, the center pin frictionally engaging the bore to fasten the top and bottom shells together when the top and bottom shells are placed in the assembled relation.

6. The hand-operated container of claim 1, further comprising:

a detent mechanism formed on the exterior surface of at least one the outer sidewalls and the interior surface of the ring.

7. The hand-operated container of claim 1, wherein the ring includes finger grips.

8. The hand-operated container of claim 1, wherein the ring includes a plurality of discharge openings.

9. The hand-operated container of claim 1, further comprising:

alignment members extending from the top shell or bottom shell.

10. The hand-operated container of claim 1, further comprising:

a magnet attached to the top shell or bottom shell.

11. The hand-operated container of claim 1, in combination with a plurality of dispensable items placed in the enclosure.

12. The hand-operated container of claim 1, wherein the ring has a groove formed on its interior surface for reducing friction between the outer sidewalls and the ring.

13. A hand-operated container having a generally cylindrical shape, comprising:

a top shell including a substantially circular top and a substantially cylindrical upper outer sidewall extending down from the top, the top overhanging the upper outer sidewall to form an upper retaining edge extending away from the upper outer sidewall;

a bottom shell including a substantially circular bottom and a substantially cylindrical lower outer sidewall extending up from the bottom, the bottom underhanging the lower outer sidewall to form a lower retaining edge extending away from the lower outer sidewall;

wherein the top shell and the bottom shell are mated to form an enclosure, a sidewall discharge opening, and a race when the top and bottom shells are place in an assembled relation, the enclosure being defined by the top, the bottom and the upper and lower outer sidewalls and the race being defined by the upper retaining edge, the lower retaining edge, and the exterior surfaces of the upper and lower outer sidewall; and a ring having a ring discharge opening and being fitted to the race for rotating in the race, the ring permitting access to the enclosure when the ring is rotated to align the ring discharge opening with the sidewall discharge opening.

14. The hand-operated container of claim 13, further comprising a magnet attached to the top shell or the bottom shell.

15. The hand-operated container of claim 13, in combination with a plurality of dispensable items placed in the enclosure.

16. A hand-operated container having a generally cylindrical shape, comprising:

a top shell including a substantially circular top and a substantially cylindrical upper outer sidewall extending down from the top and a plurality of interior walls extending radially from the center of the top to the upper outer sidewall, the upper outer sidewall having a plurality of half discharge openings formed therein, the top overhanging the upper outer sidewall to form an upper annular retaining edge extending away from the upper outer sidewall;

a bottom shell including a substantially circular bottom and a substantially cylindrical lower outer sidewall extending up from the bottom and a plurality of interior walls extending radially from the center of the top to the upper outer sidewall, the lower outer sidewall having a plurality of half discharge openings formed therein, the bottom underhanging the lower outer sidewall to form a lower annular retaining edge extending away from the lower outer sidewall;

at least one alignment member formed on the top shell or bottom shell;

wherein the top shell and the bottom shell are mated to form a plurality of compartments, a corresponding plurality of sidewall discharge openings and a race when the top and bottom shells are place in an assembled relation, the compartments being defined by the top, the bottom, the interior walls and the upper and lower outer sidewalls and the race being defined by the upper annular retaining edge, the lower annular retaining edge, and the exterior surfaces of the upper and lower outer sidewalls; and a ring having a ring discharge opening and being fitted to the race for rotating in the race, the ring permitting access to each of the compartments when the ring is rotated to align the ring discharge opening with a corresponding one of the sidewall discharge openings.

17. The hand-operated container of claim 16, further comprising:

a center column upwardly extending from the bottom;

a bore formed in the center column; and a center pin downwardly extending from the top, the center pin frictionally engaging the bore to fasten the top and bottom shells together when the top and bottom shells are placed in the assembled relation.

18. The hand-operated container of claim 16, further comprising a magnet attached to the top shell or the bottom shell.

19. The hand-operated container of claim 18, wherein the magnet is a sheet of magnetic material.

20. The hand-operated container of claim 16, in combination with a plurality of dispensable items placed in at least one of the compartments.

21. The hand-operated container of claim 16, further comprising indicia on the top corresponding to each of the compartments.

22. The hand-operated container of claim 16, further comprising a plurality of finger lugs formed on the outer surface of the top, the bottom or outer surfaces of both the top and bottom.

23. A method for manufacturing a hand-operated container, comprising:

providing a top shell including a substantially circular top and a substantially cylindrical upper outer sidewall extending down from the top, the top overhanging the upper outer sidewall to form an upper annular retaining edge extending away from the upper outer sidewall;

providing a bottom shell mated to the top shell, the bottom shell including a substantially circular bottom and a substantially cylindrical lower outer sidewall extending up from the bottom, the bottom underhanging the lower outer sidewall to form a lower annular retaining edge extending away from the lower outer sidewall;

placing a rotatable ring around lower out sidewall, the ring having a ring discharge opening; and fastening together the top shell and the bottom shell in an assembled relation so that the ring is rotatable around both the lower and upper outer sidewalls, the assembled shells forming an enclosure, a sidewall discharge opening, and a race, the enclosure being defined by the top, the bottom and the upper and lower outer sidewalls and the race being defined by the upper annular retaining edge, the lower annular retaining edge, and the exterior surfaces of the upper and lower outer sidewalls, the ring permitting access to the enclosure when the ring is rotated in the race to align the ring discharge opening with the sidewall discharge opening.

* * * * *